United States Patent [19]

Watanabe et al.

[11] Patent Number: 4,517,882

[45] Date of Patent: May 21, 1985

[54] VENTILATING DEVICE FOR A CONTAINER

[75] Inventors: Masaru Watanabe, Utsunomiya; Toshihide Sakai, Oyama; Toshio Takase, Utsunomiya, all of Japan

[73] Assignee: Fuji Heavy Industries Ltd., Tokyo, Japan

[21] Appl. No.: 486,075

[22] Filed: Apr. 18, 1983

[30] Foreign Application Priority Data

Oct. 18, 1982 [JP] Japan ..... 57-157125[U]

[51] Int. Cl.[3] ..... B60L 1/20

[52] U.S. Cl. ..... 98/6; 98/8; 98/13

[58] Field of Search ..... 98/6, 13, 37, 8; 114/177; 55/440, 444

[56] References Cited

U.S. PATENT DOCUMENTS 3,302,554 2/1967 Rousey et al. ..... 98/40 V X 4,322,234 3/1982 Mock ..... 55/440

*Primary Examiner*—William E. Wayner

*Assistant Examiner*—John M. Sollecito

*Attorney, Agent, or Firm*—Fitzpatrick, Cella, Harper & Scinto

[57] ABSTRACT

In a ventilating device for a container which comprises a container frame consisting of tubular rail members, outer ventilation holes formed through the outer wall of the rail member so as to be exposed to the outside of the container, inner ventilation holes formed through the inner wall of the rail member so as to be exposed to the interior of the container, and a ventilation channel defined inside the rail member so as to connect the inner ventilation holes and the outer ventilation holes, this ventilating device further comprises a first groove which is formed in the inner wall of the rail member so as to extend along the longitudinal direction of the rail member, and a second groove which is formed in the outer wall of the rail member so as to extend substantially parallel to the first groove, the lower wall of the first groove and the upper wall of the second groove defining a part of the ventilation channel. According to this ventilating device, the flexural rigidity of the rail member can be increased without any substantial increase in its weight as compared with such conventional ventilating devices as are arranged in rail members as well, so that the bending and buckling strength of the container may be improved, for instance, against such loads as act on the container during suspension. In addition, the device is simple in structure, and allows easy quality control and operations such as inspection and cleaning.

7 Claims, 11 Drawing Figures

VENTILATING DEVICE FOR A CONTAINER

BACKGROUND OF THE INVENTION

1. Field of the Invention

This invention relates to a ventilating device for a container, comprising a container frame consisting of tubular rail members, outer ventilation holes formed through the outer wall of the rail member so as to be exposed to the outside of the container, inner ventilation holes formed through the inner wall of the rail member so as to be exposed to the interior of the container, and a ventilation channel formed inside the rail member so as to communicate the outer and inner ventilation holes.

2. Brief Description of the Prior Art

Demands for transporting perishables such as cereal or fruit with containers are increasing. Such perishables tend to rot due to excessive moisture by aspiration of these perishables or due to condensation caused by temperature difference between inside and outside of a container. For these reasons, an increase in the capacity of a ventilating device for a container is desired.

However, problems arise if holes are simply formed on the outer surface of a container. For example, a marine container (that is, a container transported by a container ship) is subject to splashes of sea water as well as rain water. Such water may easily flow into the container and may damage the goods held therein.

In order to increase the amount of ventilation, ventilating devices for a container as shown in FIGS. 1A and 1B have been proposed. In these ventilating devices, the interiors of a top rail 1 and a bottom rail 2 comprising tubular rail members define ventilation channels.

A ventilation channel 3 of a ventilating device of these types has a configuration as shown in FIG. 1A or 1B. In the ventilation channel 3 shown in FIG. 1A, drain plates 6 project inward in a staggered manner from inner and outer walls 4 and 5, respectively. In the ventilation channel 3 shown in FIG. 1B, a drain plate 7 projects from an inner wall 4, where the drain plate 7 is bent at its intermediate portion and has an opening 11. Ventilation air is introduced from the outside to the interior of the container through outer ventilation holes 8, the ventilation channel 3 and inner ventilation holes 9. The ventilation air makes a detour or collides against the drain plate 6 or 7, so that moisture may be satisfactorily removed therefrom.

However, since the drain plate 6 or 7 is mounted on the rail member 1 or 2 by welding, rivetting or the like, narrow corners or gaps are formed at the mounting portions. Dust and the like tend to deposit in these corners, and the deposited material becomes dampened.

This causes rusting or formation of mildew to shorten the service life of the container. In addition to this, these corners or gaps are hard to clean, presenting the problem of bad hygiene condition, especially in the case of containers for transporting perishables.

Furthermore, in the case as shown in FIG. 1A wherein the drain plates 6 are inclined, even if fastening members 10 are loosened to remove the inner wall 4, the lower surfaces of the drain plates 6 mounted on the outer wall 10 are hard to inspect. On the other hand, in the case as shown in FIG. 1B wherein the drain plate 7 is bent inward, the bent portion of the drain plate 7 is similarly hard to inspect. In either case, if the rail members 1 and 2 are subjected to a surface treatment, the problems of quality control are apt to occur as well as the cleaning and inspecting problems as mentioned above.

In the cases shown in FIGS. 1A and 1B, the drain plates 6 and 7 must be prepared separately from the rail members 1 and 2 and must then be fixed thereto by welding or rivetting. This results in a larger number of parts and complex mounting procedures. The structures shown in FIGS. 1A and 1B are, therefore unsuitable for mass-production.

SUMMARY OF THE INVENTION

It is an object of the present invention to provide a ventilating device for a container, which utilizes a container frame consisting of tubular rail members.

It is another object of the present invention to provide a ventilating device for a container, in which the flexural rigidity of a rail member may be increased without any substantial increase in its weight, so that the bending strength and buckling strength of the container are significantly improved under such loads as act on the container, when hung up.

It is still another object of the present invention to provide a ventilating device for a container, in which it is hard for dust and/or water to collect inside the device, so that the service life of the container is prolonged and the hygiene condition is improved.

It is still another object of the present invention to provide a ventilating device for a container, which is simple in structure, is suitable for mass-production, and easily allows quality control and various operations such as cleaning and inspection.

The above and other objects of the present invention may be achieved by a ventilating device for a container, comprising a container frame consisting of tubular rail members, outer ventilation holes formed through an outer wall of the rail member so as to be exposed to the outside of the container, inner ventilation holes formed through an inner wall of the rail member so as to be exposed to the interior of the container, and a ventilation channel defined inside the rail member so as to communicate the inner and outer ventilation holes, characterized in that the ventilating device further comprises a first groove which is formed in an inner side wall of the rail member so as to extend along the longitudinal direction of the rail member, and a second groove which is formed in an outer side wall of the rail member so as to extend substantially parallel to the first groove, a lower wall of the first groove and an upper wall of the second groove defining a part of the ventilation channel.

Various other objects, advantages and features of the present invention will become readily apparent from the ensuing detailed description, and the novel features will be particularly pointed out in the appended claims

BRIEF DESCRIPTION OF THE DRAWINGS

FIG. 1 shows conventional ventilating devices for a container, wherein

FIGS. 2 and 3 show one embodiment of a ventilating device of this invention as applied to a marine container, wherein FIG. 2 is an overall perspective view of the container, and FIG. 3 is a longitudinal sectional view of the ventilating device for the container shown in FIG. 2; and FIGS. 4 to 10 show other embodiments of this invention as applied to marine containers having ventilating devices in wall panels, too, wherein FIG. 4 is an overall perspective view of the container, FIG. 5 is a longitudinal sectional view of the side wall portion of the container shown in FIG. 4, FIG. 6 is a sectional view of the container shown in FIG. 5 taken along the line VI—VI therein, FIG. 7 is a sectional view of the container shown in FIG. 5 taken along the line VII—VII therein, FIG. 8 is a partial cutaway perspective view of part of the ventilating device shown in FIG. 5 which is mounted in a wall panel, FIG. 9 is a cross-sectional view of the ventilating device according to a modification which is mounted on a wall panel having ventilation holes, and FIG. 10 is a longitudinal sectional view of the main part of a ventilating device according to a modification which is mounted on a wall panel and having a partition wall in a ventilation channel.

DETAILED DESCRIPTION OF THE PREFERRED EMBODIMENTS

One embodiment of the present invention as applied to a ventilating device for a marine container will now be described with reference to FIGS. 2 and 3.

Figure 2:
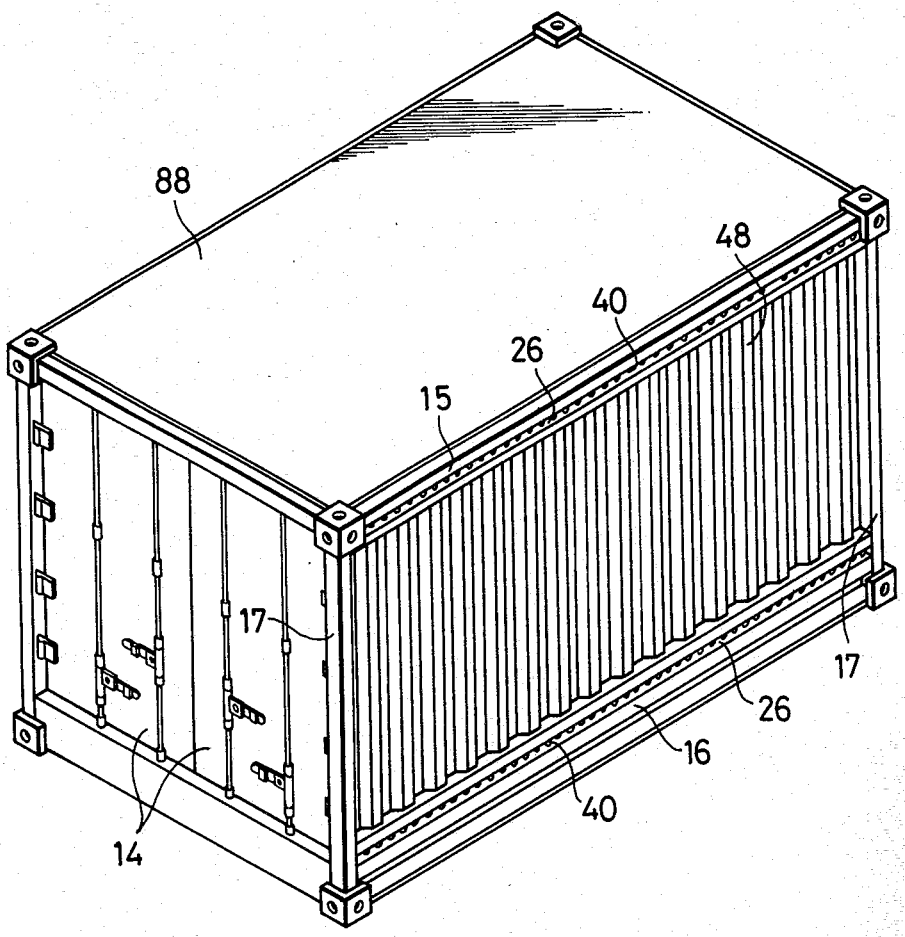

A marine container (to be referred to as a container for brevity hereinafter) is a hexahedral receptacle having folding doors 14 at the rear as shown in FIG. 2. The container has a frame which consists of a top rail 15 and a bottom rail 16 which are arranged at its upper and lower portions and two pairs of columns 17 at its front and rear portions, respectively.

Figure 3:
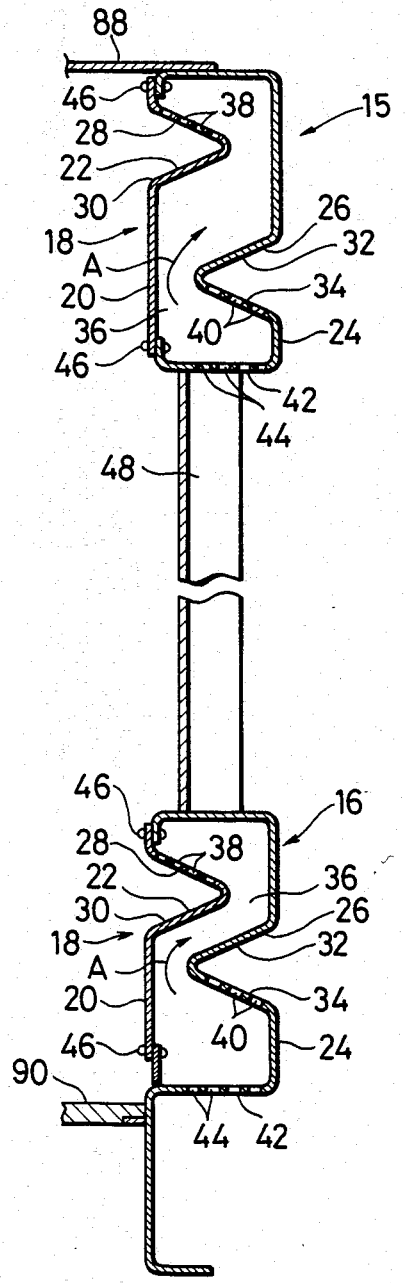

As shown in FIG. 3, each of the top and bottom rails 15 and 16 of the container frame comprises tubular rail members 18 which has a substantially rectangular sectional shape. A first groove 22 of a V-shaped sectional shape or the like is formed in an inner side wall 20 of the rail member 18 facing inside the container so as to extend along the longitudinal direction thereof. Similarly, a second groove 26 of a V-shaped sectional shape or the like is formed in an outer side wall 24 of the rail member 18 facing outside the container.

As shown in FIG. 3, the first and second grooves 22 and 26 are formed in a staggered manner. A lower wall 30 of the first groove 22 and an upper wall 32 of the second groove 26 are substantially parallel to each other, and a space therebetween defines a part of a ventilation channel 36.

The ventilation channel 36 is thus formed utilizing the tubular inner space of the rail member 18. A number of inner ventilation holes 38 are formed in an upper wall 28 of the first groove 22, and a number of outer ventilation holes 40 are formed in a lower wall 34 of the second groove 26. The inner and outer ventilation holes 38 and 40 communicate with each other through the ventilation channel 36.

Drain holes 44 serving also as outer ventilation holes are formed in a lower wall 42 of the rail member 18. Moisture separated from the air in the ventilation channel 36 in a manner to be described later is exhausted mainly through these drain holes 44.

The inner side wall 20 is removable from the rail member 18 by loosening a plurality of fastening members 46 such as screws. Therefore, cleaning and inspection of the inner space of the rail member 18 are facilitated. Note that reference numeral 88 denotes a container roof plate, and 90 denotes a container floor plate.

In case of the ventilating device for the container composed as described above, the air flowing into the ventilation channel 36 from the outside through the outer ventilation holes 40 or drain holes 44 of the top or bottom rail 15, 16, flows upward through the space which is defined between the lower wall 30 of the first groove 22 and the upper wall 32 of the second groove 26, that is, as indicated by an arrow A in FIG. 3. The air then enters into the container through the inner ventilation holes 38 as ventilation air. The flow of ventilation air containing a certain amount of moisture changes its direction to pass through the crooked ventilation channel 36, so that the flow of ventilation air sometimes collides against the walls 30 and 32 of the grooves 22 and 26, or the walls 20 and 24 of the rail member 18, and sometimes becomes a turbulent flow to allow separation of moisture. The separated water flows downward by its own weight and is exhausted mainly through the drain holes 44.

In this manner, since the ventilation air is introduced into the container after being dried, it will not dampen the goods inside the container.

The air which flows from the interior to the exterior of the container flows the path as described above in the reverse order starting from the inner ventilation holes 38 and flows out through the outer ventilation holes 40 and 44.

The interior of the container is ventilated by the ventilation air which enters through the bottom rail 16 and flows out through the top rail 15. For this reason, even if perishables are loaded in the container, rotting and/or deterioration of the goods may be prevented.

Since the inner ventilation holes 38 are formed in the upper wall 28 of the first groove 22 which is recessed from the inner side wall 20, they may not be closed by the goods in the container. The inner ventilation holes 38 are oriented upward, so that small pieces of goods or dust may hardly be introduced therein.

Although the ventilating device is arranged in both the top and bottom rails 15 and 16 in the embodiment described above, it may be arranged only in one of them.

Figure 1A:
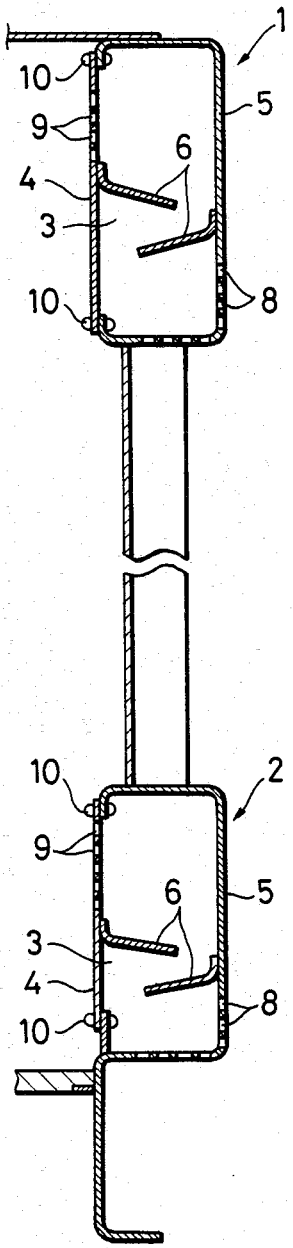
FIG.1A (PRIOR ART)
FIG. 1A is a partial longitudinal view of a container wherein two drain plates are mounted inside the device.
Figure 1B:
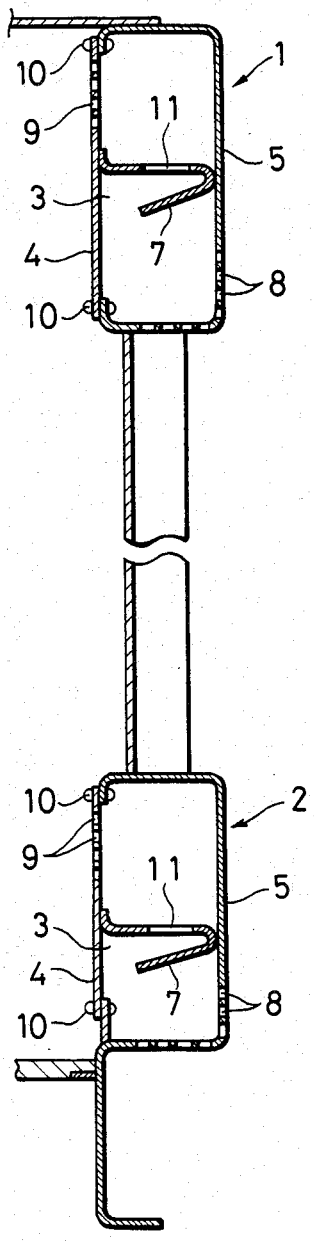
FIG.1B (PRIOR ART)
FIG. 1B is a partial longitudinal sectional view of a container wherein one drain plate is mounted inside the device.

The cross-sectional shape of the grooves 22 and 26 is not limited to the V-shape but may be U-shaped or arcuate. As has been mentioned earlier, the lower surface of the drain plate 6 is hard to inspect in the case shown in FIG. 1A, while the bent portion of the drain plate 7 is hard to inspect in the case shown in FIG. 1B. With a view to solve this problem, the cross-sectional shape of the grooves 22 and 26 is preferably such that no dead space is formed therein so as to allow easy inspection, cleaning and repair of the device.

The outer ventilation holes 40 may be formed at any position from the range of the lower wall 34 of the second groove 26 to the lower wall 42 of the rail member 18. However, if the outer ventilation holes 40 are formed in the lower wall 34, external air enters downward inside the container. Therefore, if splashes of seawater or the like are contained in the air, they may be immediately removed and exhausted through the drain holes 44 in this case, resulting in higher efficiency of separation of water or moisture from the ventilation air.

In accordance with the embodiment shown in FIGS. 2 and 3, the tubular inner space of the rail member 18 is utilized to improve the space factor inside the container, while guaranteeing satisfactory ventilation of the container loaded with perishables.

The rail member 18 of the embodiment has uneven side walls which serve in place of the drain plates in the conventional devices. This structure eliminates need for welding or rivetting of separate drain plates to the rail member 18. For this reason, the flexural rigidity of the rail member 18 is increased without any substantial increase in its weight, so that the bending strength and buckling strength of the container against a load during suspension of the container or the like may be significantly improved.

As has been described above, the walls of the grooves function as drain plates, so that separate drain plates need not be mounted by welding or rivetting. Corners or gaps are not, therefore, formed at the mount portions and collection of water or dust therein is thus prevented. Rusting or formation of mildew are also prevented so as to improve the service life of the container. Good hygiene condition is also guaranteed when the container carries perishables.

Since the inner structure of the ventilating device is simplified as compared to conventional devices, inspection and cleaning are facilitated. When the interior of the ventilating device is subjected to a surface treatment, quality control during manufacturing is facilitated. Manufacturing cost is reduced and manufacturing steps are shortened.

Other embodiments wherein the present invention is applied to marine containers which have also ventilating devices in wall panels 48 as well will now be described with reference to FIGS. 4 to 10. In a description to follow, the same reference numerals as in FIGS. 2 and 3 denote the same parts, and a detailed description thereof is omitted.

In the embodiments shown in FIGS. 4 to 10, substantially the same ventilating device is arranged for each of a top rail 15 and a bottom rail 16 as in the embodiment shown in FIGS. 2 and 3.

Figure 5:
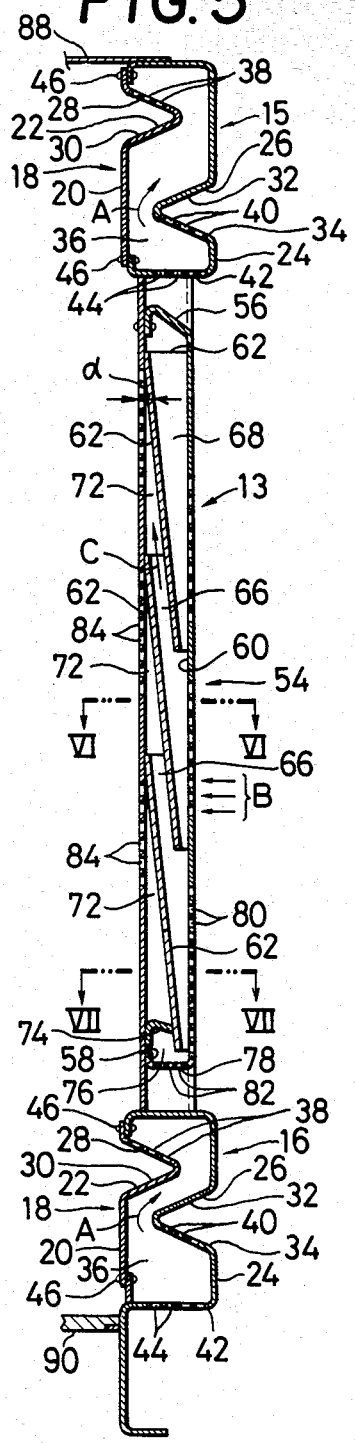
Figure 4:
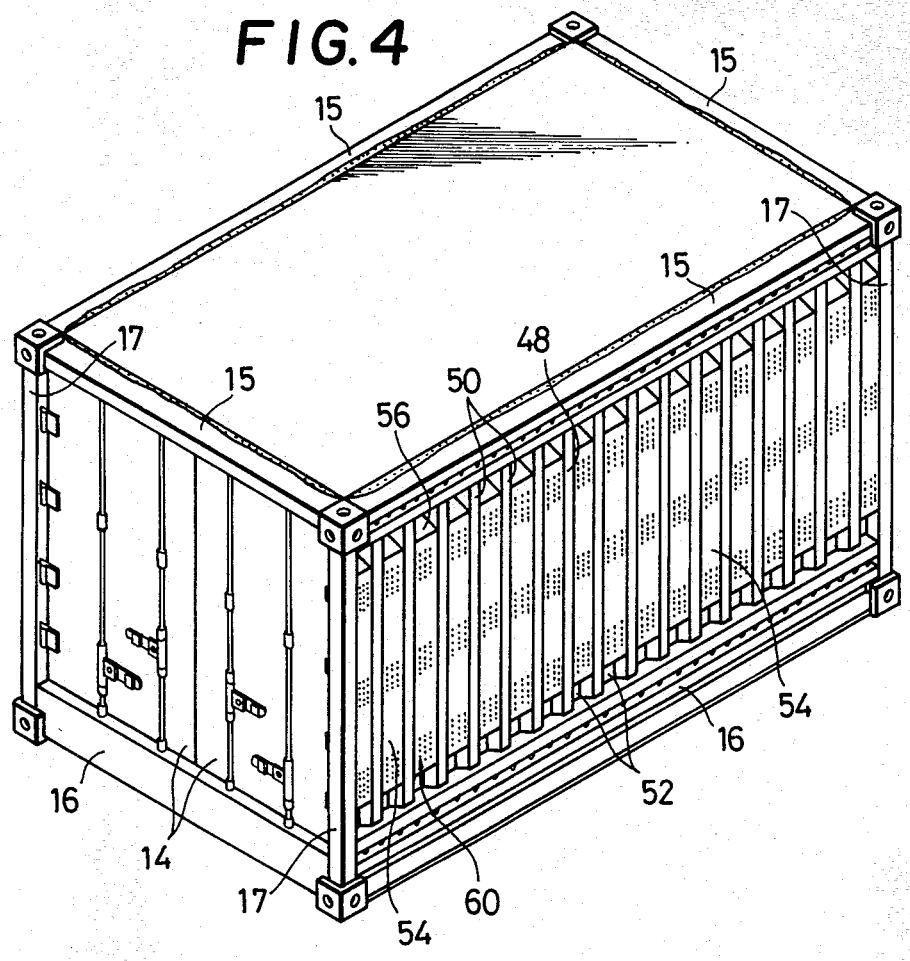
Figure 6:
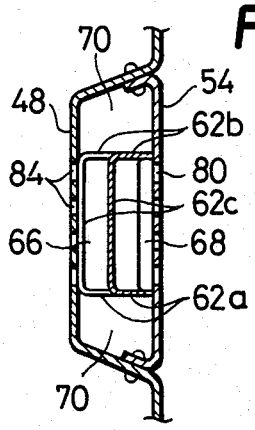
Figure 7:
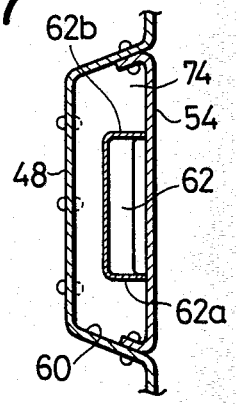
Figure 8:
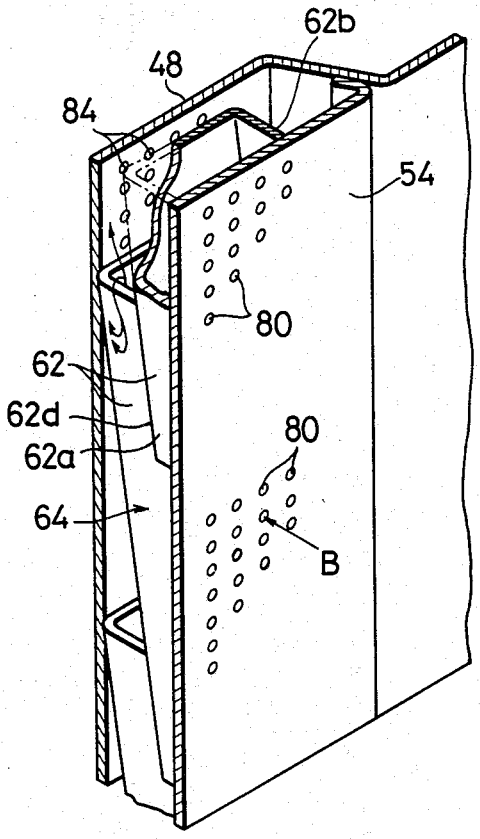

The wall panel 48 comprises a corrugated plate 18 having even parallel ridges 50 and furrows 52. Referring to FIG. 4, the container frame consists of a top rail 15, a bottom rail 16 and two pairs of front and rear columns 17. The corrugated plate 18 is fitted inside the container frame such that the ridges 50 and furrows 52 extend vertically. A ventilating device is arranged for each of the furrows 52 of the wall panel 48. More specifically, a lid plate 54 is mounted to cover each furrow 52 in a view from the outside of the container. As shown in FIG. 5, the upper portion of each lid plate 54 is bent to form a shed roof 56 of the ventilating device to allow easy flow of water. The upper and lower ends of each lid plate 54 are bent to form bent portions 58 which allow surface contact with the wall panel 48. The bent portions 58 and the side edges of the lid plate 54 are fixed to the wall panel 48 to form a long, narrow ventilation chamber 60 as shown in FIG. 5. A plurality of long drain plates 62 are arranged inside the ventilation chamber 60 such that the upper ends of them are in contact with the wall panel 40 and they extend downward therefrom. The drain plates 62 parallel to one another are inclined slightly against the wall panel 48 and arranged at equal intervals along the longitudinal direction of the ventilation chamber 60. The drain plates 62 next to each other are arranged in such manner that the lower portion of the upper drain plate and the upper portion of the lower drain plate overlap with each other. The interval between a pair of flanges **62*a* and 62*b* of the drain plate 62 made of channel iron or the like is substantially constant along the longitudinal direction of the drain plate 62, as shown in FIGS. 6 to 8. The upper end of a web 62*c* of the drain plate 62 is in contact with the wall panel 48** as described above.

Referring to FIG. 8, in order that the flanges **62*a* and 62*b* of the drain plates 62 next to each other may not overlap, the flanges 62*a* and 62*b* of the lower drain plate 62 are cut off and the flanges 62*a* and 62*b* of the upper drain plate 62 are fitted in cut-out portions 60*d*, thereby defining continuous vertical partition walls 64**.

A first ventilation channel 66 is formed between the adjacent drain plates 62. An air-water separation chamber 68 is formed between the drain plate 62 and the lid plate 54. The first ventilation channels 66 and the air-water separation chambers 68 are formed at the center portion of the ventilation chamber 60 in the transverse direction. Further, a pair of second ventilation channels 70 are formed at both sides of the ventilation chamber 60. A communication channel 72 is formed above each drain plate 62, surrounded by the upper drain plate 62 and the wall panel 48. Each first ventilation channel 66 communicates with the second ventilation channels 70 through the communication channel 72.

A partition wall 74 is mounted in the vicinity of the lower end of the lowermost drain plate 62. The partition wall 74 provides a seal between the lower parts of the second ventilation channels 70 and the lower part of the communication channel 72 surrounded by the lowermost drain plate 62 and the wall panel 48, thereby defining a drain chamber 76 below the ventilation chamber 60 communicating with the air-water separation chamber 68.

Figure 9:
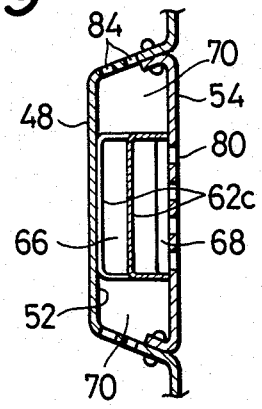

First ventilation holes 80 communicating with the outside of the container are formed in one side wall defining the air-separation chamber 68, that is, the front surface portion of the lid plate 54, and drain holes 82 are formed in the lower wall 78 of the ventilation chamber 60, that is, the lower surface portion of the lid plate 54. Second ventilation holes 84 communicating with the interior of the container are formed in the portion of the wall panel 48 defining the communication channel 72, that is, the bottom portion of the furrow 52 of the wall panel 48 excluding its upper and lower ends. As shown in FIG. 9, the second ventilation holes 84 formed in the wall panel 48 may be formed in the side walls of the furrow 52 of the wall panel 48.

In the ventilating device mounted in the wall panel 48 as described above, as shown in FIGS. 5 and 8, the ventilation air containing moisture and flowing in the direction indicated by an arrow B through the first ventilation holes 80 from the outside of the container collides against the drain plate 62 and expends its kinetic energy. The water in the ventilation air whose mass is greater, flows down along the drain plate 62 inside the air-water separation chamber 68 and is exhausted mainly through the drain holes 82 of the lower wall 78. The ventilation air from which the moisture has been removed, then flows upward through the first ventilation channel 66 as indicated by an arrow C in FIG. 5, and reaches the communication channel 72. The ventilation air then partly flows into the container through the second ventilation holes 84, and partly flows upward or downward in the second ventilation channel 70 and then flows into the container through the upper or lower second ventilation holes 84.

In this embodiment, since the first ventilation holes 80 communicating with the outside of the container are formed in the side walls of the ventilating device, the ventilation air having a large vector component in the horizontal direction flows into the ventilation chamber 60 easily. However, since the angle $\alpha$ between the drain plate 62 and the wall panel 48 is very small, the water in the ventilation air after a collision against the drain plate 62 can hardly be introduced upward to the first ventilation channel 66 to reach the communication channel 72. The ventilation air having a large vector component in the vertical direction can hardly pass through the first ventilation holes 80 communicating with the outside of the container. Even if such ventilation air flows into the air-water separation chamber 68 through the first ventilation holes 80, it has consumed most of its kinetic energy by then. For this reason, the moisture contained in this ventilation air may hardly enter through the first ventilation channel 66 to reach the communication channel 72.

Upward splashes of sea water may easily enter through the drain holes 82 formed in the lower wall 78 of the ventilation chamber 60. However, due to the presence of the partition wall 74, such splashes may not flow into the container through the second ventilation holes 84 either directly or via the second ventilation channel 70 and communication channel 72. Even if a considerable amount of splashes of sea water tends to flow upward from the drain chamber 76 to the air-water separation chamber 68, a number of ventilation holes 80 formed in the side wall of the air-water separation chamber 68 easily allow discharge of such water.

The ventilating device mounted on a wall panel 48 may be mounted inside the container utilizing the ridges 50 of the wall panel 48. In this case, the positions of the wall panel 48 and the lid plate 54 shown in FIG. 5 are reversed.

In the embodiment described above, the drain plates 62 may be at least more than two in number. Although the drain plates 62 are equally distanced from each other in the embodiment described above, they may be arranged in a different manner. The upper end of each drain plate 62 and the wall panel 48 need not be in contact with each other, but some gap may be formed therebetween.

It is not necessary that the section of the drain plate 62 is channel-shaped to form the partition walls 64 extending along almost the whole length of the lid plate 54 by the interconnection of the flanges 62*a* and 62*b* respectively of the drain plates 62. Instead, the partition walls 64 may be formed by fixing partition plates respectively to each side of the drain plates 62.

In case of the above mentioned embodiment as shown in FIG. 8, the boundary between the communicating channel 72 and the second ventilation channel 70 became triangular as shown in FIG. 5 due to the use of the drain plate 62 with channel section. However, when the partition walls 64 are formed as in this modification, the shape of the boundary may be freely selected. Depending upon the selected shape of the boundary, a function of the water separation from the air which flows from the communication channel 72 to the second ventilation channel 70, may be rendered to the partition walls 64.

Figure 10:
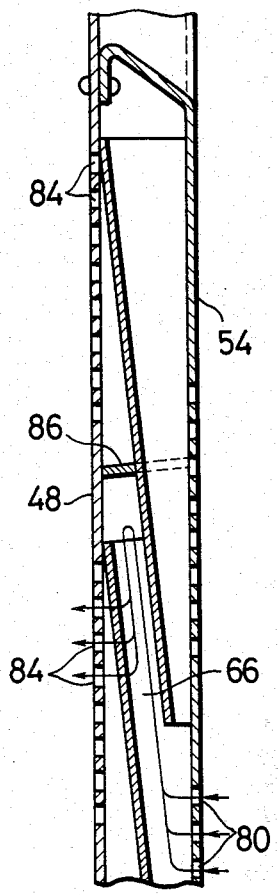

As shown in FIG. 10, a partition wall 86 may be mounted within the communication channel 72 to be in the vicinity of the outlet of the first ventilation channel 66. In this case, the ventilation air flowing out of the first ventilation channel 66 mostly flows into the second ventilation channel 70 through the communication channel 72 and flows downward. The air then flows into the container through the second ventilation holes 84 formed in the lower communication channel 72. In this manner, the path of the air does not only wind but also becomes long, so that the air-water separation efficiency is improved.

In the embodiments or modifications shown in FIGS. 4 to 10, a number of ventilating devices may be formed in the wall panel 48 in addition to those as shown in FIGS. 2 and 3. For this reason, a large amount of ventilation air may be supplied to the container.

Although the present invention has been described with reference to the embodiments of marine containers, the present invention may be similarly applied to ventilating devices of many other types of containers.

What is claimed is:

1. A ventilating device for a container, comprising a container frame consisting of tubular rail members, outer ventilation holes formed through an outer wall of said rail member so as to be exposed to the outside of said container, inner ventilation holes formed through an inner wall of said rail member so as to be exposed to the interior of said container, and a ventilation channel defined inside said rail member so as to provide communication between said inner ventilation holes and said outer ventilation holes, characterized in that said ventilating device further comprises a first groove which is formed in an inner side wall of said rail member so as to extend along a longitudinal direction of said rail member, and a second groove which is formed in an outer side wall of said rail member so as to extend substantially parallel to said first groove, a lower wall of said first groove and an upper wall of said second groove defining a part of said ventilation channel, said inner ventilation holes being formed in an upper wall of said first groove.

2. A device according to claim 1, characterized in that at least one of said first groove and said second groove has a V-shaped sectional shape.

3. A device according to claim 1, characterized in that said outer ventilation holes are formed in a lower wall of said second groove.

4. A device according to claim 1, characterized in that said inner side wall is detachable.

5. A device according to claim 1, characterized in that at least some of said outer ventilation holes are formed in a lower wall of said rail member.

6. A device according to claim 1, characterized in that said lower wall of said first groove and said upper wall of said second groove are substantially parallel to each other.

7. A device according to claim 1, characterized in that said rail members comprise a top rail and a bottom rail of said container frame.

* * * * *